US007978030B2

(12) United States Patent
Lee et al.

(10) Patent No.: US 7,978,030 B2
(45) Date of Patent: Jul. 12, 2011

(54) HIGH-SPEED INTERCONNECTS

(75) Inventors: Yuheng Lee, San Jose, CA (US); Jianying Zhou, Acton, MA (US); Yan Yang Zhao, Fremont, CA (US); Christopher R. Cole, Redwood City, CA (US); Bernd Huebner, Santa Clara, CA (US)

(73) Assignee: Finisar Corporation, Sunnyvale, CA (US)

( * ) Notice: Subject to any disclaimer, the term of this patent is extended or adjusted under 35 U.S.C. 154(b) by 356 days.

(21) Appl. No.: 12/030,142

(22) Filed: Feb. 12, 2008

(65) Prior Publication Data

US 2008/0191818 A1 Aug. 14, 2008

Related U.S. Application Data

(60) Provisional application No. 60/889,469, filed on Feb. 12, 2007, provisional application No. 60/974,386, filed on Sep. 21, 2007, provisional application No. 60/982,666, filed on Oct. 25, 2007.

(51) Int. Cl.
*H01P 1/00* (2006.01)

(52) U.S. Cl. ..... 333/247; 333/254

(58) Field of Classification Search ..... 333/33, 333/246, 247, 254
See application file for complete search history.

(56) References Cited

U.S. PATENT DOCUMENTS

| | | | | |
|---|---|---|---|---|
| 5,561,405 | A | 10/1996 | Hoffmeister et al. | |
| 6,062,872 | A | 5/2000 | Strange et al. | |
| 6,599,031 | B2 | 7/2003 | Li | |
| 6,614,325 | B1 | 9/2003 | Kocin | |
| 6,796,723 | B2 * | 9/2004 | Kim et al. | 385/88 |
| 6,876,836 | B2 | 4/2005 | Lin et al. | |
| 6,949,992 | B2 | 9/2005 | Sweeney et al. | |
| 7,002,428 | B2 * | 2/2006 | McMorrow et al. | 333/20 |
| 7,076,123 | B2 | 7/2006 | Kirkpatrick et al. | |
| 7,334,946 | B2 * | 2/2008 | Lu | 385/88 |
| 2003/0179055 | A1 | 9/2003 | Sweeney et al. | |

(Continued)

FOREIGN PATENT DOCUMENTS

KR 10-2005-0030022 3/2005

OTHER PUBLICATIONS

International Searching Authority, International Application No. PCT/US2008/053756, Written Opinion of the International Searching Authority and International Search Report, mailed Jun. 25, 2008.

*Primary Examiner* — Stephen E Jones
(74) *Attorney, Agent, or Firm* — Maschoff Gilmore & Israelsen

(57) ABSTRACT

In one example embodiment, a high-speed transponder includes a printed circuit board having a set of coplanar high-speed traces, and a high-speed circuit and a package mounted to the printed circuit board. The package includes an outside housing and a second high-speed circuit positioned inside the housing. The high-speed transponder also includes a high-speed feed thru which includes an inside coplanar structure positioned inside the housing, a strip line structure positioned through the housing, and an outside coplanar structure positioned outside the housing. The second high-speed circuit is operably coupled to the inside coplanar structure, which is operably coupled to the strip line structure, which is operably coupled to the outside coplanar structure, which is operably coupled to the first high-speed circuit via the set of coplanar high-speed traces. The signal plane of the outside coplanar structure is flipped with respect to a signal plane of the inside coplanar structure.

9 Claims, 20 Drawing Sheets

U.S. PATENT DOCUMENTS

2003/0222282 A1 12/2003 Fjelstad et al.
2005/0224946 A1 10/2005 Dutta
2005/0237137 A1 10/2005 Dutta
2005/0239418 A1 10/2005 Koh et al.
2006/0028305 A1 2/2006 Dutta et al.
2009/0033442 A1 2/2009 Zhao et al.

* cited by examiner

HIGH-SPEED INTERCONNECTS

CROSS-REFERENCE TO RELATED APPLICATIONS

The present application claims priority from U.S. Provisional Patent Application Ser. No. 60/889,469, filed Feb. 12, 2007 and entitled "High-Speed Interconnect System Over a Printed Circuit Board," U.S. Provisional Patent Application Ser. No. 60/974,386, filed Sep. 21, 2007 and entitled "Non-Coplanar Interconnects," and U.S. Provisional Patent Application Ser. No. 60/982,666, filed Oct. 25, 2007 and entitled "Feed Thru with Flipped Signal Plane," each of which is incorporated herein by reference in its entirety.

BACKGROUND

High-speed transponders generally require multiple high-speed interconnects. For example, a 40 G transponder may include various components that must be interconnected using high-speed interconnects capable of reliably transmitting signals at 40 G. Typically, manufacturers of high-speed transponders use coax cable and GPPO or V-connectors as high-speed interconnects.

While some high-speed transponders employ single-ended interconnects that require only one cable between components, other high-speed transponders employ differential interconnects that require two cables between components. Still other high-speed transponders employ multiple differential interconnects in a transmitter chain, and multiple differential signal interconnects in a receiver chain. The complexity and cost of a high-speed transponder increases with the number of cables used as interconnects. Employing coax cable and GPPO or V-connectors as high-speed interconnects is expensive and can therefore limit the market potential of high-speed transponders.

BRIEF SUMMARY OF SOME EXAMPLE EMBODIMENTS

In general, example embodiments of the invention relate to high-speed interconnects for electrically connecting electrical signal routes between integrated circuits (ICs) and/or optoelectric circuits (OCs) and packages that include ICs and/or OCs.

In one example embodiment, a high-speed transponder includes a printed circuit board having a set of coplanar high-speed traces, a high-speed circuit mounted to the printed circuit board, and a package mounted to the printed circuit board. The package includes an outside housing and a second high-speed circuit positioned inside the housing. The high-speed transponder also includes a high-speed feed thru. The high-speed feed thru includes an inside coplanar structure positioned inside the housing, a strip line structure positioned through the housing, and an outside coplanar structure positioned outside the housing. The inside coplanar structure is operably coupled to the second high-speed circuit. The strip line structure is operably coupled to the inside coplanar structure. The outside coplanar structure is operably coupled to the strip line structure and to the first high-speed circuit via the set of coplanar high-speed traces. In this example embodiment, a signal plane of the outside coplanar structure is flipped with respect to a signal plane of the inside coplanar structure.

In another example embodiment, a high-speed transponder includes a printed circuit board having a set of coplanar high-speed traces, a first package mounted to the printed circuit board, and a second package mounted to the printed circuit board. The first package includes a first set of coplanar high-speed transmission lines and the second package includes a second set of coplanar high-speed transmission lines. The high-speed transponder further includes a non-coplanar high-speed interconnect connecting the set of coplanar high-speed traces to the first set of coplanar high-speed transmission lines, and a high-speed interconnect connecting the set of coplanar high-speed traces to the second set of coplanar high-speed transmission lines.

In yet another example embodiment, a high-speed package includes a first layer and a second layer. The first layer includes a first set of coplanar high-speed transmission lines. The second layer includes a second set of coplanar high-speed transmission lines. A non-coplanar high-speed interconnect connects the first set of high-speed transmission lines to the second set of high-speed transmission lines.

In still another example embodiment, a high-speed transponder includes a printed circuit board, a first high-speed package mounted to the printed circuit board, and a second high-speed package mounted to the printed circuit board. The printed circuit board includes a set of high-speed traces. The first high-speed package includes a first set of high-speed transmission lines. The second high-speed package includes a second set of high speed transmission lines. The high-speed transponder further includes a first high-speed interconnect that connects the set of high-speed traces to the first set of high-speed transmission lines, and a second high-speed interconnect that connects the set of high-speed traces to the second set of high-speed transmission lines.

These and other aspects of example embodiments of the invention will become more fully apparent from the following description and appended claims.

BRIEF DESCRIPTION OF THE DRAWINGS

To further clarify certain aspects of example embodiments of the invention, a more particular description of the invention will be rendered by reference to example embodiments thereof which are disclosed in the appended drawings. It is appreciated that these drawings depict only example embodiments of the invention and are therefore not to be considered limiting of its scope nor are they necessarily drawn to scale. Aspects of example embodiments of the invention will be described and explained with additional specificity and detail through the use of the accompanying drawings in which.

DETAILED DESCRIPTION OF SOME EXAMPLE EMBODIMENTS

In general, example embodiments disclosed herein are directed to high-speed interconnects for electrically connecting electrical signal routes between integrated circuits (ICs) and/or optoelectric circuits (OCs) and packages that include ICs and/or OCs. The term "high-speed" as used herein refers to data rates of about 15 G or above. For example, the term "high-speed" as used herein encompasses a data rate of about 40 G. Some example interconnects disclosed herein enable high-speed electrical signals, such as data, clock and other signals, to be transferred between packages via traces on a printed circuit board (PCB) that are configured for such transmission (PCB-based high-speed interconnects). Moreover, some example interconnects disclosed herein are configured such that standard package configurations can be employed, obviating the need for specialized IC and OC packages commonly used in high-speed transponders, such as GPPO equipped packages. Additionally, example PCB-based high-speed interconnects disclosed herein are scalable such that high-speed data rates, such as 40 G, 100 G, or higher, can be accommodated. Thus, the example PCB-based high-speed interconnects disclosed herein can be employed to simplify the complexity of transponder design while enabling high-speed signal transfer to occur between its constituent packages. The example interconnects disclosed herein can be less expensive, and therefore have better market potential, than interconnects that employ relatively expensive coax cable and GPPO or V-connectors.

I. Example Transponders

Figure 1:
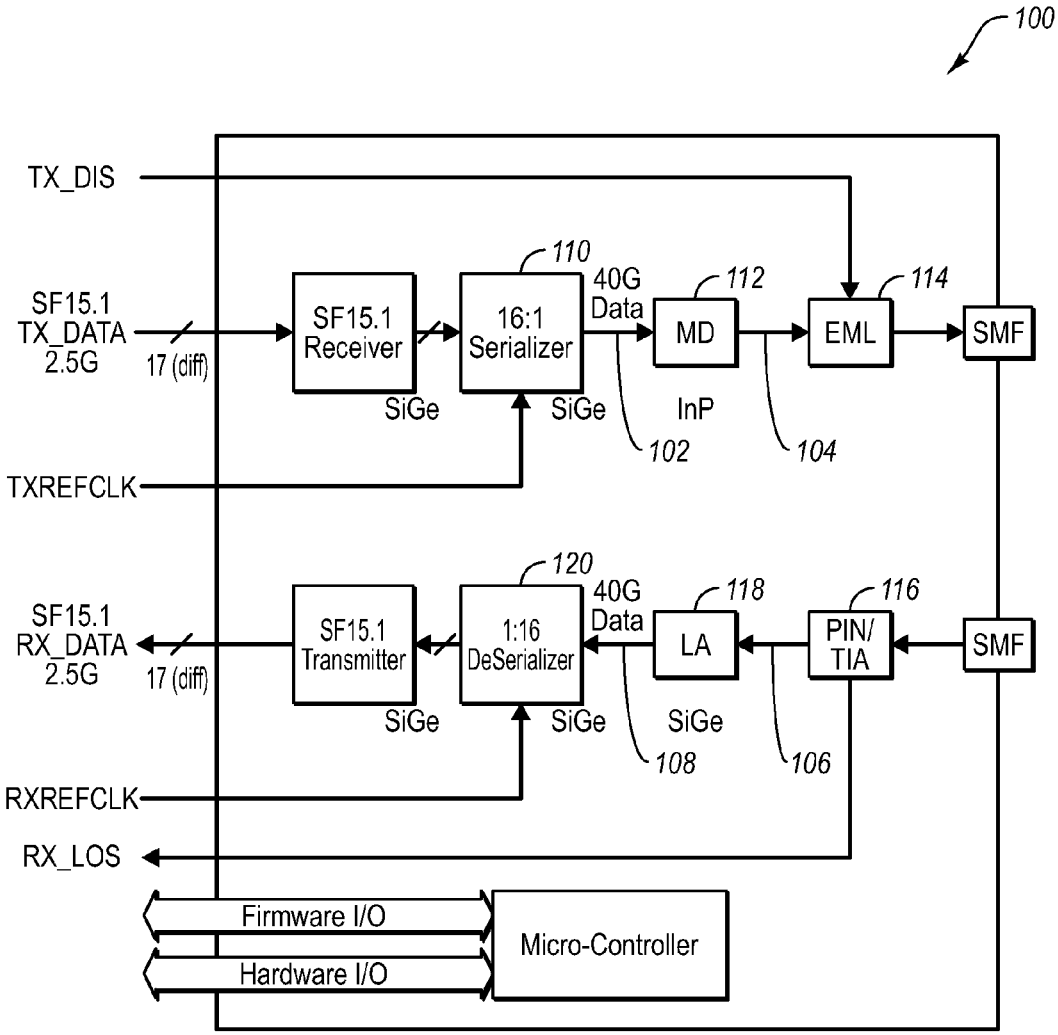
FIG. 1 is a simplified block diagram of an example high-speed transponder.

With reference first to FIG. 1, an example high-speed transponder 100 is disclosed. As disclosed in FIG. 1, the example transponder 100 has multiple 40 G interconnects 102-108. In particular, a serializer 110 is connected to a mod driver (MD) 112 via the 40 G interconnect 102. The MD 112 is connected to an electro absorption modulator+CW DFB laser (EML) 114 via the 40 G interconnect 104. In addition, a PIN/TIA 116 is connected to an LA 118 via the 40 G interconnect 106. The LA 118 is connected to a deserializer 120 via the 40 G interconnect 108. Each of the 40 G interconnects 102-108 can be implemented using aspects of the example PCB-based high-speed interconnects disclosed herein.

Figure 2:
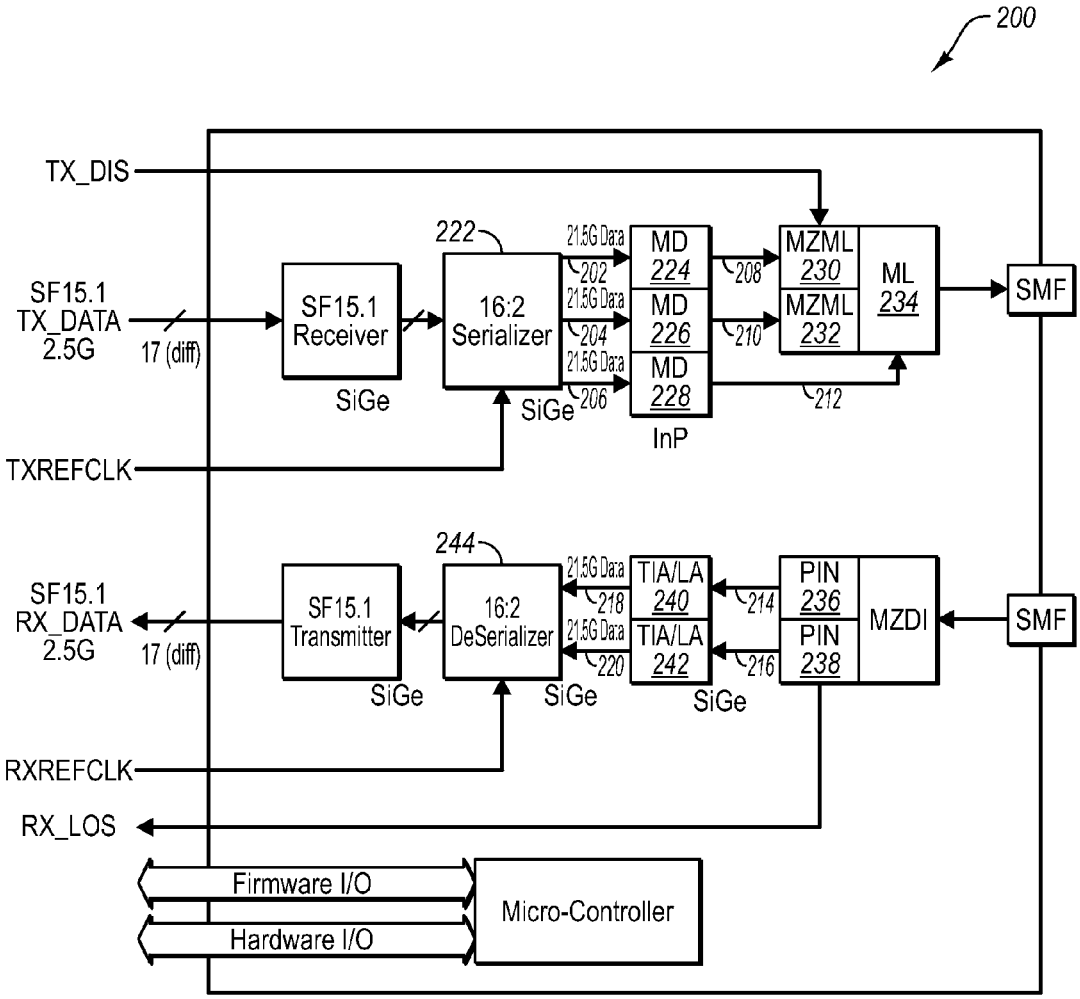
FIG. 2 is a simplified block diagram of another example high-speed transponder.

With reference now to FIG. 2, another example high-speed transponder 200 is disclosed. As disclosed in FIG. 2, the example transponder 200 has multiple 21.5 G interconnects 202-220. In particular, a serializer 222 is connected to MDs 224, 226, and 228 via the 21.5 G interconnects 202, 204, and 206, respectively. The MDs 224, 226, and 228 are connected to Mach Zender modulator lasers (MZMLs) 230 and 232 and a modulator (ML) 234 via the 21.5 G interconnects 208, 210, and 212, respectively. In addition, PINs 236 and 238 are connected to TIA/LAs 240 and 242 via the 21.5 G interconnects 214 and 216, respectively. The TIA/LAs 240 and 242 are connected to a deserializer 244 via the 21.5 G interconnects 218 and 220. Each of the 21.5 G interconnects 202-220 can be implemented using aspects of the example PCB-based high-speed interconnects disclosed herein. Where the 21.5 G interconnects 202-220 are single-ended, the 21.5 G PCB-based high-speed interconnects 202-220 can be employed instead of ten cables, resulting in significant cost savings. Where the 21.5 G interconnects 202-220 are differential, the 21.5 G PCB-based high-speed interconnects 202-220 can be employed instead of twenty cables, resulting in even greater cost savings.

II. Example PCB-Based High-Speed Interconnect Systems

Figure 3A:
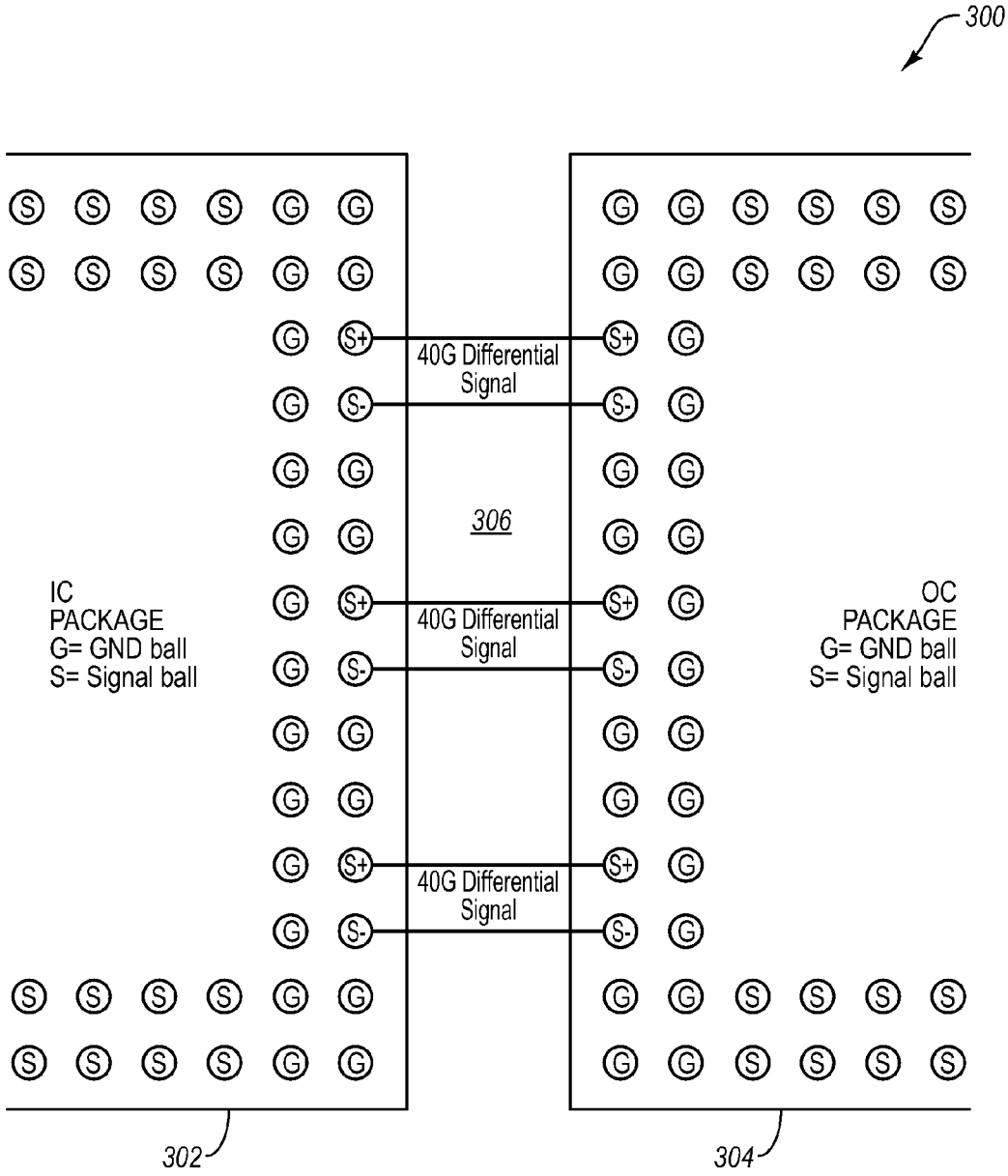
FIG. 3A is a schematic view of an example PCB-based high-speed interconnect system.

With reference now to FIG. 3A, aspects of an example PCB-based high-speed interconnect system 300 are disclosed. The example package interconnect system 300 can be used to interconnect, for example, ICs, OCs, IC packages, OC packages, or some combination thereof. The system 300 can be employed with both specialty packages and standard packages, thereby allowing for its use with either or a combination of both package types.

FIG. 3A discloses bottom surfaces of an IC package 302 and an OC package 304. The IC packages 302 package contains one or more ICs. The OC package 304 contains one or more OCs. For example, the IC package 302 may contains a serializer similar to the serializers disclosed in FIGS. 1 and 2, while the OC package 304 may contain a co-packaged MD/EML component, similar to the MD and EML components disclosed in FIGS. 1 and 2. In another embodiment, however, the interconnect system 300 can instead be employed between two IC packages, such as a serializer and an MD where the MD is packaged separately from the EML, similar to those disclosed in FIGS. 1 and 2. Thus, the example package interconnect system 300 may be employed with many different circuit or package combinations.

In one example embodiment, the IC(s) contained by the IC package 302 disclosed in FIG. 3A may utilize flip chip technology for interconnecting within the package itself. Alternatively, wire bonding or other suitable interconnection technology may be employed to connect the ICs to the IC package 302. The OC(s) of the OC package 304 are also operably connected to the OC package 304 in a suitable manner. The IC(s) and OC(s) within the respective IC package 302 and the OC package 304 may also be operably connected using the example non-coplanar interconnects disclosed herein in connection with FIGS. 12-19.

As disclosed in FIG. 3A, the bottom of both the IC package 302 and the OC package 304 include a ball grid array ("BGA") configuration having a plurality of solder balls. Selected solder ball pairs are configured so as to be able to transmit high-speed signals. Further, the high-speed signals are differential signals and as such utilize both a positive and negative polarity solder ball as a pair.

The differential solder ball signal pairs of the IC package 302 are operably coupled with corresponding solder ball pairs of the OC package 304 via a PCB 306 that is configured to carry high-speed signals. As such, in one embodiment, the substrate of the PCB 306 is composed of Nelco, or other suitable material. Suitable contact pads and signal traces are formed on the PCB 306 so as to electrically connect the corresponding pairs of differential solder ball pairs of the BGAs of both the IC package 302 and OC package 304.

So configured, the example interconnect system 300 disclosed in FIG. 3A can transmit high-speed signals between the IC package 302 and the OC package 304. Further, the example interconnect system 300 can be scaled for multiple parallel high-speed signal streams. This aspect is disclosed in FIG. 3A, wherein three differential 40 G signal ball pairs are shown. The configuration disclosed in FIG. 3A can accommodate up to four differential signal pairs, though it is appreciated that in other embodiments the number of signal pairs may be more or less than three. Also, though they are configured to carry a 40 G signal, the differential BGA solder ball signal pairs can be configured in other embodiments to carry signals having rates above or below this as may be needed for a particular application.

In some example embodiments, the IC package 302 may have the following characteristics: Medium, low speed, and power pin-count: ~200 pins or balls; Power dissipation: ~4 W; High-speed signal count: up to 4 differential signal pairs per side (i.e. 8 total); BGA flip-chip IC, BGA wire-bonded IC, or other suitable surface mount package; HTCC or LTCC substrate for the PCB; Heat dissipation away from the PCB attach. In some example embodiments, the OC package 304 may have the following characteristics: Medium, low speed, and power pin-count: ~100 pins or balls; Power dissipation: ~6 W; High-speed signal count: up to 4 differential signal pairs; Multiple internal components mounted on the substrate; Compatible with fiber mounting; HTCC or LTCC substrate for the PCB; Heat dissipation away from the PCB attach. Of course, these example characteristics are not meant to be restrictive, and other example characteristics are possible. For example, higher pin counts are possible.

Figure 3B:
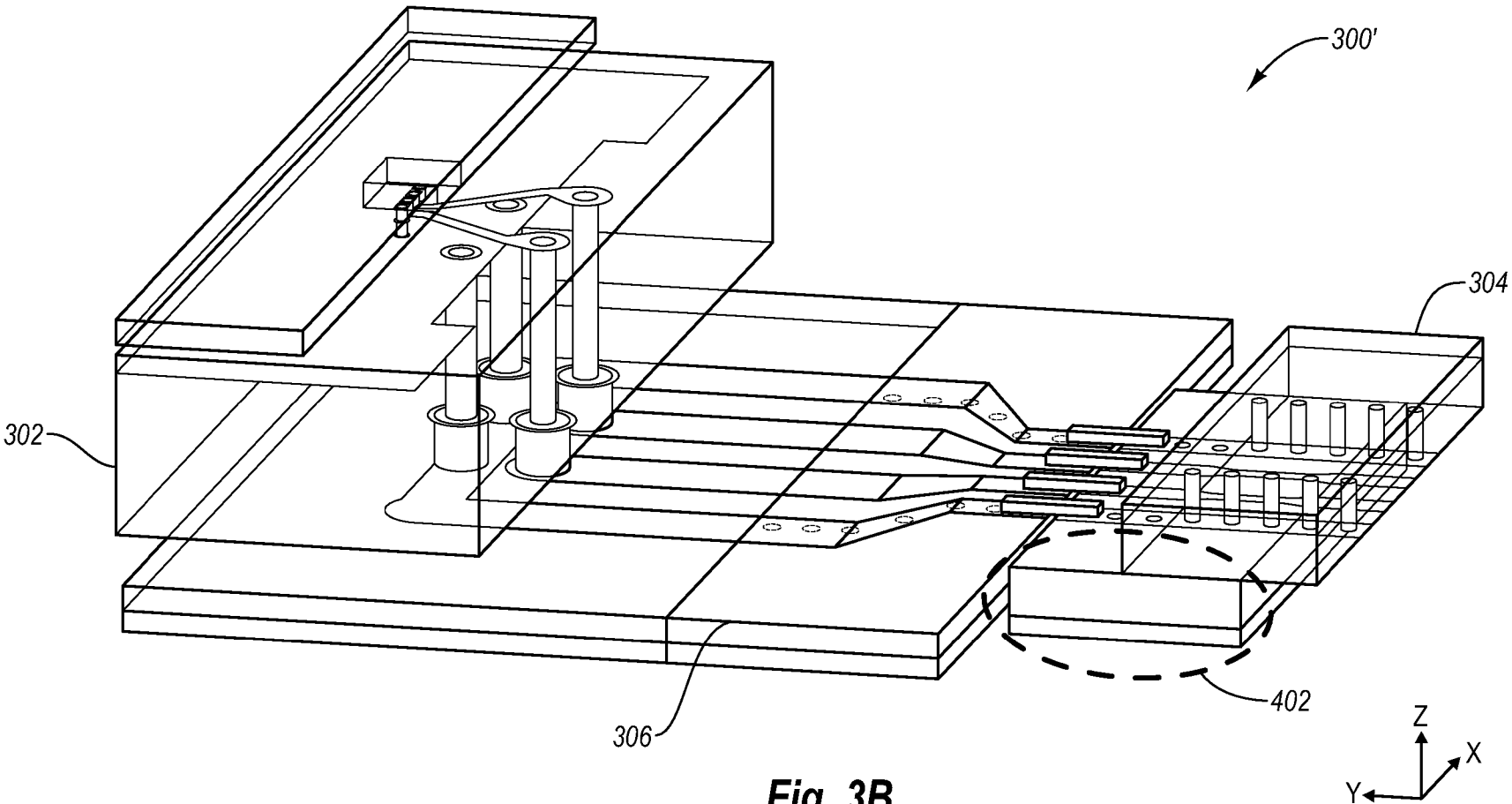
FIG. 3B is a perspective view of another example PCB-based high-speed interconnect system.

With reference now to FIG. 3B, aspects of another example PCB-based high-speed interconnect system 300' are disclosed. Like the interconnect system 300, the interconnect system 300' can be to interconnect, for example, ICs, OCs, IC packages, OC packages, or some combination thereof. The system 300' can also be employed with both specialty packages and standard packages, thereby allowing for its use with either or a combination of both package types.

FIG. 3B discloses the IC package 302 and the OC package 304 connected via the PCB 306. However, unlike the system 300 which employs a BGA in connection with the OC package 304, the system 300' employs a feed through 402, as discussed below in connection with FIG. 4, to couple the OC package 304 to the IC package 302 via the PCB 306. As disclosed in FIG. 3B, the IC package 302 also employs aspects of the non-coplanar high-speed interconnects disclosed elsewhere herein. Thus, FIGS. 3A and 3B disclose two PCB-based high-speed interconnect systems.

The cost of the PCB-based high-speed interconnects disclosed herein, compared to the cost of a conventional coax cable-based interconnects, is significantly less expensive. In particular, standard computer IC packages and PCB assembly processes may be advantageously substituted for expensive microwave techniques when the example PCB-based high-speed interconnects disclosed herein are employed in a transponder.

Two particularly problematic areas for PCB-based high-speed interconnects are the connections between the traces on a PCB and the high-speed transmission lines in a package, and the connections between different layers of high-speed transmission lines within a package. Overcoming some of the challenges associated with the connections between the traces on a PCB and the high-speed transmission lines in a package can be accomplished by employing a feed thru with a flipped signal plane, as disclosed below in connection with FIGS. 4-11B. Overcoming some of the challenges associated with the connections between the traces on a PCB and the high-speed transmission lines in a package and with the connections between different layers of high-speed transmission lines within a package can be accomplished by employing non-coplanar interconnects, as disclosed below in connection with FIGS. 12-19.

III. Example Feed Thru with a Flipped Signal Plane

With reference now to FIGS. 4-11B, aspects of feed thrus with a flipped signal plane are disclosed. These example feed thrus can be used as high-speed interconnects in systems with high-speed RF signals without adversely effecting the thermal management of the systems.

One environment in which the example feed thrus disclosed herein can be employed is high-speed transponders. For example, transponders compliant with the 40 G 300 pin MSA may employ one or more of the example feed thrus disclosed herein. Further, the example transponders 100 and 200 disclosed herein in connection with FIGS. 1 and 2, respectively, may employ one or more of the example feed thrus disclosed herein. It is noted, however, that the example feed thrus disclosed herein are not limited to employment in high-speed transponders, but can also be employed in any environment where packages contain high-speed OCs or ICs.

The term "feed thru" as used herein refers to a high-speed interconnect between a high-speed circuit inside a package mounted to a PCB and another high-speed circuit or package mounted to the PCB. The example feed thrus disclosed herein generally have a coplanar structure inside a package and a coplanar structure outside the package, where the signal plane outside the package which is flipped relevant to the signal plane inside the package. The coplanar signal plane can be configured as a strong coupling, as discussed elsewhere herein, in order to minimize or eliminate a field mode change and discontinuity due to the signal plane flip. However, a weak coupling in a strip line structure for a simplified design may alternatively be employed, depending on the operating frequencies required.

Figure 4:
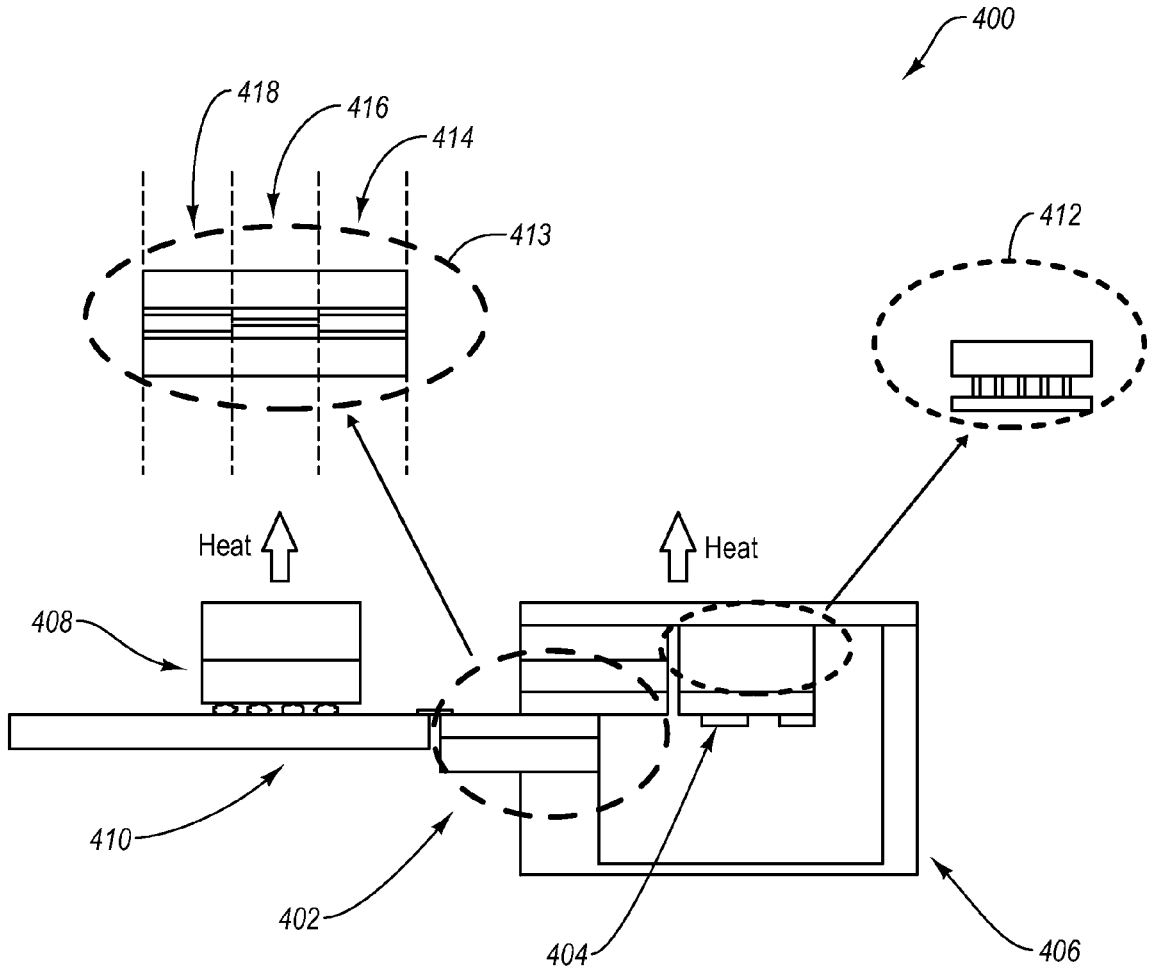
FIG. 4 is a schematic illustration of an example system having an example feed thru.

With reference now to FIG. 4, an example system 400 having an example feed thru 402 is disclosed. As disclosed in FIG. 4, the example feed thru 402 has a flipped signal plane. The example feed thru 402 of FIG. 4 also enables a heat sink (not shown) for the circuit 404 inside the package 406 to be positioned in the same orientation (i.e. above the system 400) as a heat sink (not shown) for the high power ICs 408 on the PCB 410, and thus simplify the thermal management of the system 400. As disclosed in FIG. 4, the circuit 404 may optionally be a temperature control circuit (TEC) 412. The housing of the package 406 may be formed from metal, for example. The configuration of the example feed thru 402 of FIG. 4 also enables RF signal integrity to be maintained when using a strong coupling, the structure of which will be described in greater detail below.

As disclosed in a top view 413 of the example feed thru 402 of FIG. 4, the example feed thru 402 includes at least three sections, a coplanar structure 414 (such as coplanar waveguide) inside the package 406, a strip line structure 416 through the housing of the package 406, and a coplanar structure 418 outside package 406, which results in the signal plane inside the package 406 being flipped with respect to the signal plane outside the package 406. The flip of the signal plane can generate mode change and discontinuity. As a result, RF signal integrity, represented by reflection (S11) and forward transmission (S21), may be degraded, particularly for higher frequencies. In order to avoid the negative effects of mode change and discontinuity, and depending on the operating frequencies required, the feed thru can be configured with a strong coupling coplanar structure and a strong coupling strip line structure.

Figure 5A:
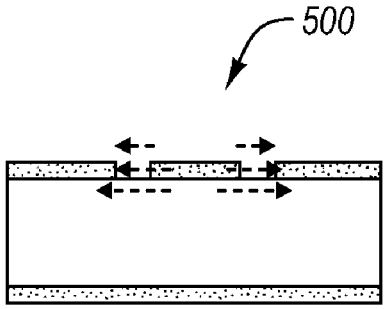
FIG. 5A is a schematic illustration of field distributions on coplanar GSG structures employing the example feed thru of FIG. 4 configured as a strong coupling.
Figure 5B:
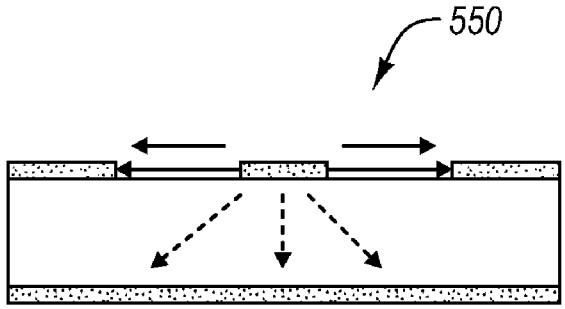
FIG. 5B is a schematic illustration of field distributions on coplanar GSG structures employing the example feed thru of FIG. 4 configured as a weak coupling.

With reference now to FIGS. 5A and 5B, a strong coupling coplanar structure 500 and a weak coupling coplanar structure 550, respectively, are disclosed. As disclosed in FIG. 5A, the electric fields in the strong coupling coplanar structure 500 are concentrated in the signal plane. In contrast, as disclosed in FIG. 5B, the electric fields in the weak coupling coplanar structure 550 are spread to bottom or top ground.

Figure 6A:
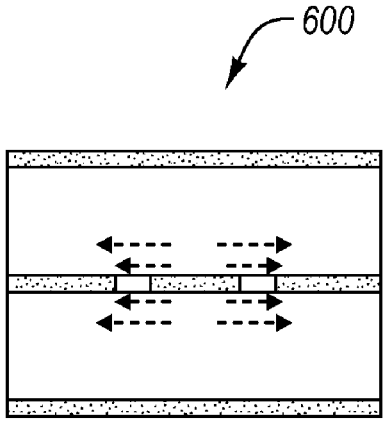
FIG. 6A is a schematic illustration of field distributions on single-ended GSG strip line structures employing the example feed thru of FIG. 4 configured as a strong coupling.
Figure 6B:
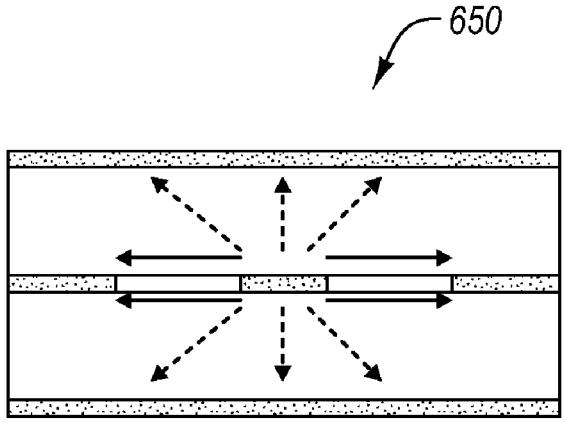
FIG. 6B is a schematic illustration of field distributions on single-ended GSG strip line structures employing the example feed thru of FIG. 4 configured as a weak coupling.

With reference now to FIGS. 6A and 6B, a strong single-ended GSG strip line structure 600 and a weak single-ended GSG strip line structure 650, respectively, are disclosed. As disclosed in FIG. 6A, the field distributions of the strong coupling strip line structure 600 can be concentrated to a signal plane. In contrast, as disclosed in FIG. 6B, the fields distribution of the weak coupling strip line structure 650 spread to top and bottom grounds. With a strong coupling, the field mode change or discontinuity due to the signal plane flip is minimized or eliminated and thus the frequencies of the spurious modes are moved to higher frequencies, thus enabling a package to operate at higher frequencies by using the example feed thru disclosed herein configured with a strong coupling.

Figure 7A:
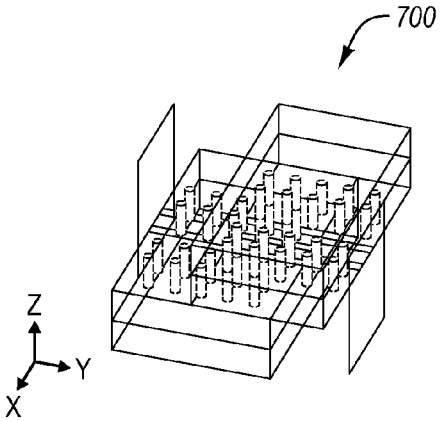
FIG. 7A is a perspective view of the example feed thru of FIG. 4 configured as a single-ended GSG structure with a strong coupling.
Figure 7B:
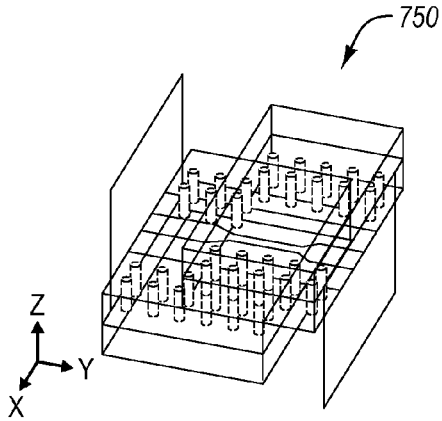
FIG. 7B is a perspective view of the example feed thru of FIG. 4 configured as a single-ended GSG structure with a weak coupling.

With reference now to FIGS. 7A and 7B, the example feed thru of FIG. 4 is disclosed as a single-ended GSG structure with a strong coupling 700 and a single-ended GSG structure with a weak coupling 750, respectively. The example feed thrus disclosed in FIGS. 7A and 7B are based on 50 ohm single-ended GSG structures. The trace width and gap of the coplanar waveguide of the strong coupling 700 of FIG. 7A are about 300 um and about 180 um, respectively. In contrast, the trace width and gap of the coplanar waveguide of the weak coupling 750 of FIG. 7B are about 450 um and about 600 um, respectively. Both feed thrus are formed from about 500 um thick ceramic material, with a dielectric constant equal to about 9.2.

Figure 8A:
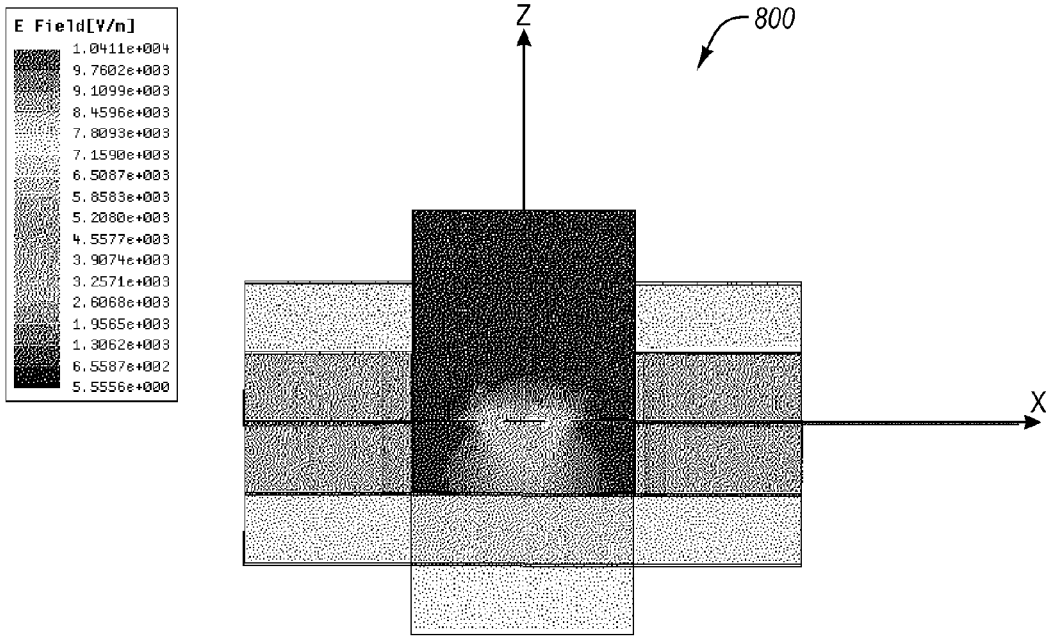
FIG. 8A is a chart showing simulated field distributions at an input port of the example feed thru of FIG. 7A.
Figure 8B:
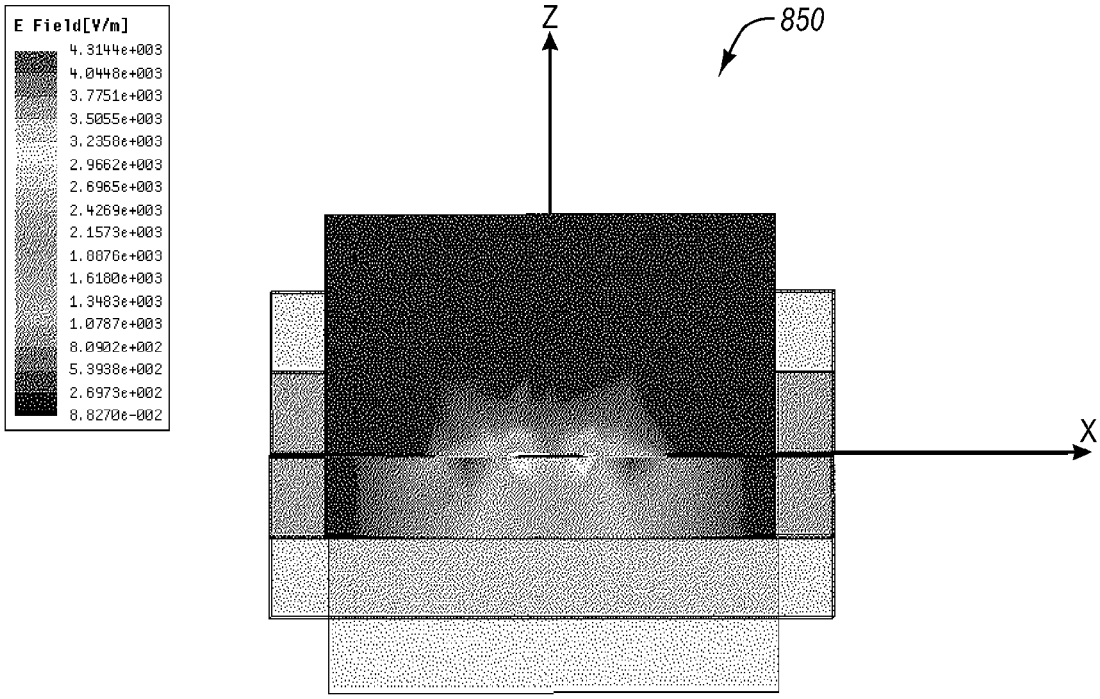
FIG. 8B is a chart showing simulated field distributions at an input port of the example feed thru of FIG. 7B.

With reference now to FIGS. 8A and 8B, charts 800 and 850 showing simulated field distributions at an input port of the example feed thrus of FIGS. 7A and 7B, respectively, are disclosed. The charts 800 and 850 demonstrate that electric fields are concentrated in the signal plane with a strong coupling, while the electric fields are spread to the top and bottom ground with a weak coupling.

Figure 9A:
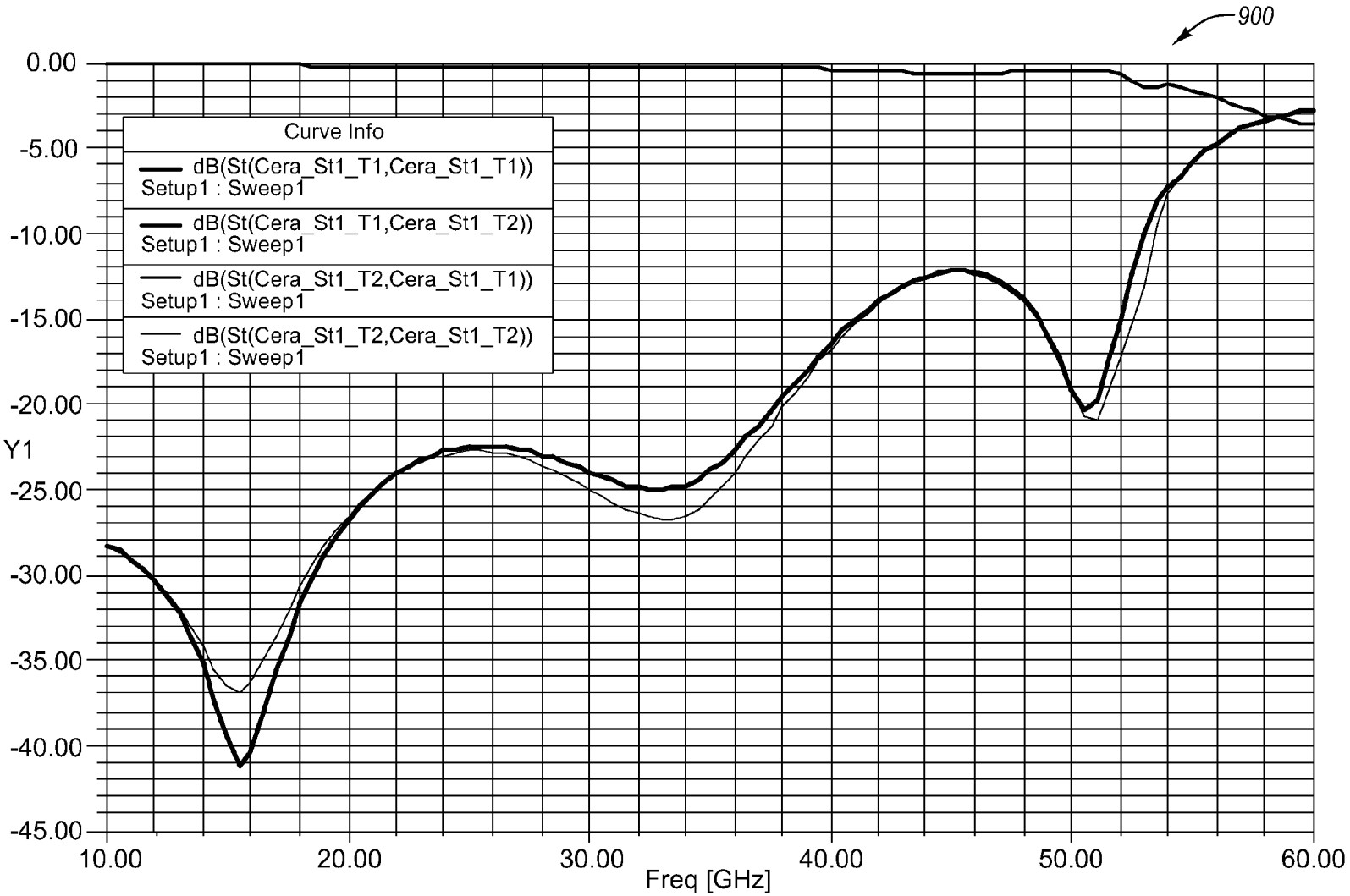
FIG. 9A is a chart showing simulated S-parameters of the example feed thru of FIG. 7A.
Figure 9B:
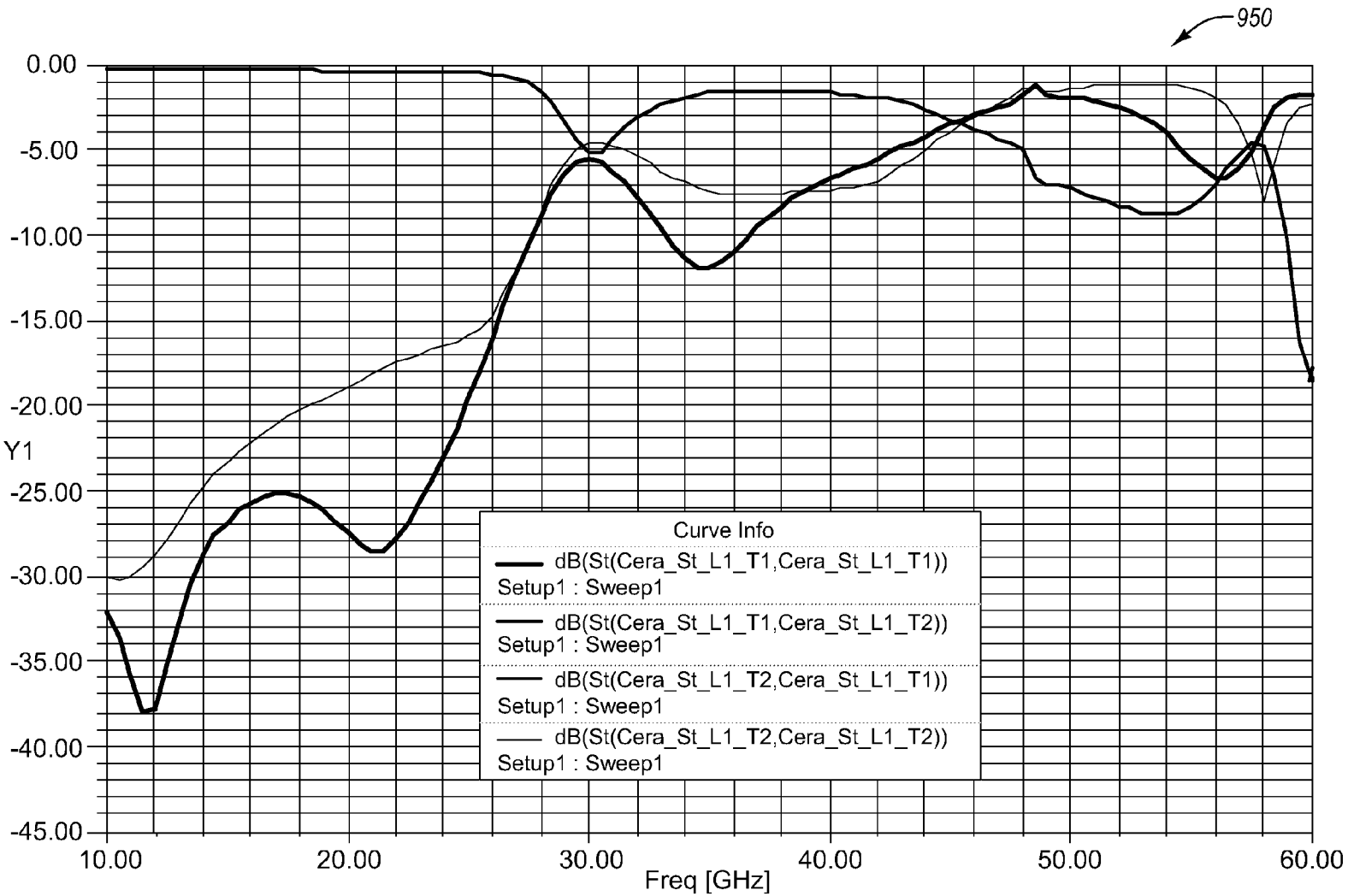
FIG. 9B is a chart showing simulated S-parameters of the example feed thru of FIG. 7B.

With reference now to FIGS. 9A and 9B, charts 900 and 950 showing simulated S-parameters of the example feed thrus of FIGS. 7A and 7B, respectively, are disclosed. The charts 900 and 950 of FIGS. 9A and 9B demonstrate that the feed thru with a strong coupling 700 of FIG. 7A can operate with a frequency range above about 50 GHz, while the feed thru with a weak coupling 750 of FIG. 7B can only operate below about 30 GHz.

Certain aspects of the feed thrus of FIGS. 7A and 7B can be implemented in feed thrus having a variety of different transmission line structures including, but not limited to, ground-signal-ground-signal-ground (GSGSG) differential pair, and ground-signal-signal-ground (GSSG) differential pair. For example, a GSGSG differential pair can be treated as two independent single-ended GSG structures, as discussed above.

Figure 10A:
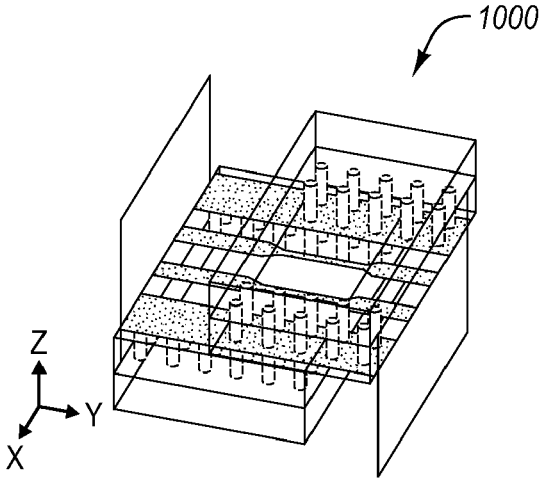
FIG. 10A is a perspective view of the example feed thru of FIG. 4 configured as a differential pair GSSG structure with a strong coupling.
Figure 10B:
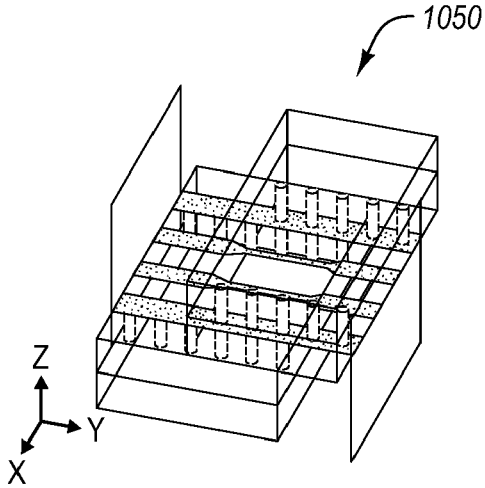
FIG. 10B is a perspective view of the example feed thru of FIG. 4 configured as a differential pair GSSG structure with a weak coupling.

With reference now to FIGS. 10A and 10B, the example feed thru of FIG. 4 is disclosed as a differential pair GSSG structure with a strong coupling 1000 and a differential pair GSSG structure with a weak coupling 1050, respectively. The example feed thrus disclosed in FIGS. 10A and 10B are based on 100 ohm differential pair GSSG structures. The GSSG structure with a strong coupling 1000 of FIG. 10A has about 800 um pitch for both signal-to-signal and signal-to-ground, while the GSSG structure with a weak coupling 1050 of FIG. 10B has about 1600 um pitch for signal-to-signal and about 800 um pitch for signal-to-ground. The pitch is the distance between the middle of a first line and the middle of a second line. Both feed thrus are formed from about 500 um thick ceramic material, with a dielectric constant equal to about 9.2.

Figure 11A:
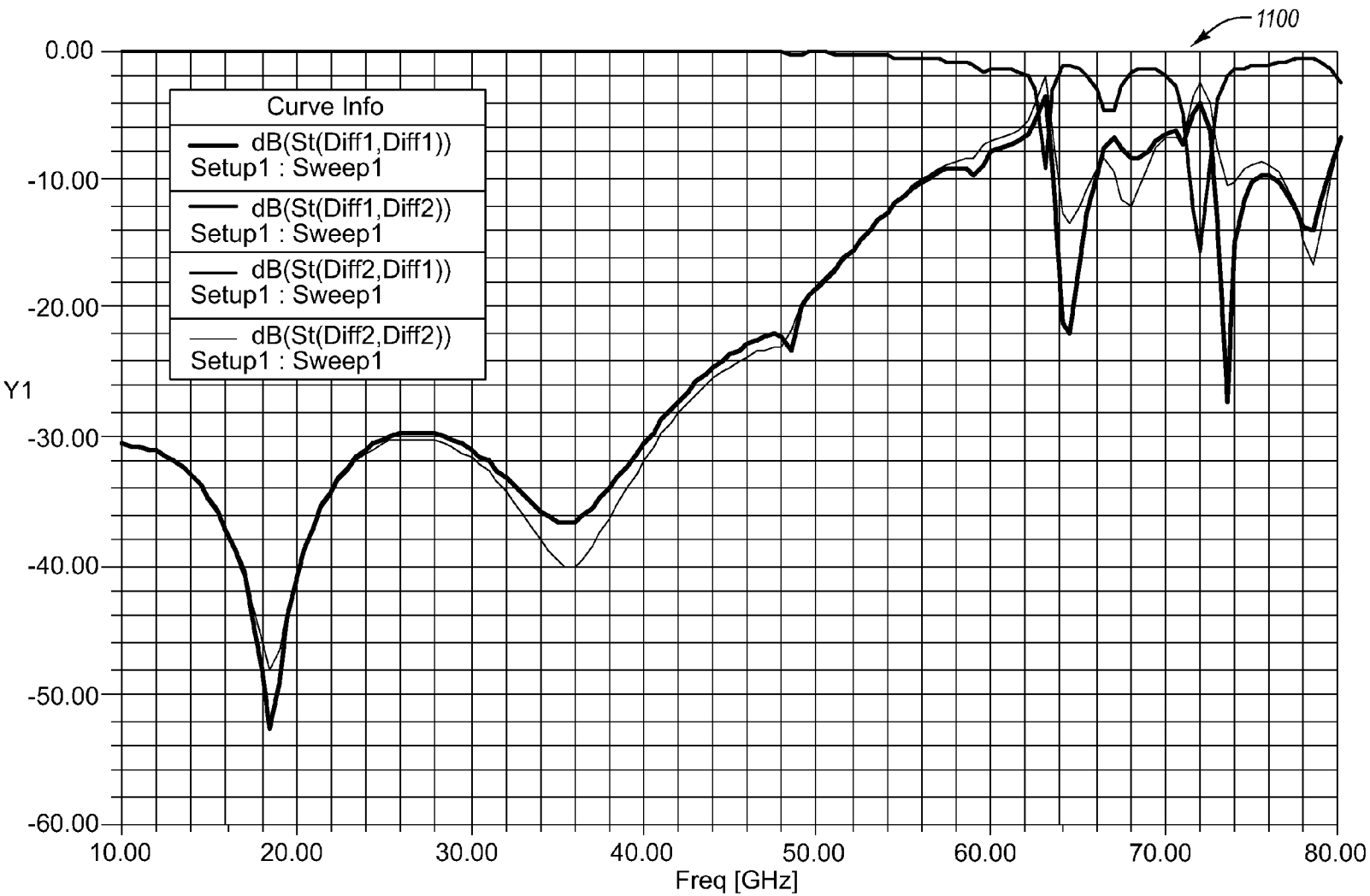
FIG. 11A is a chart showing simulated S-parameters of the example feed thru of FIG. 10A.
Figure 11B:
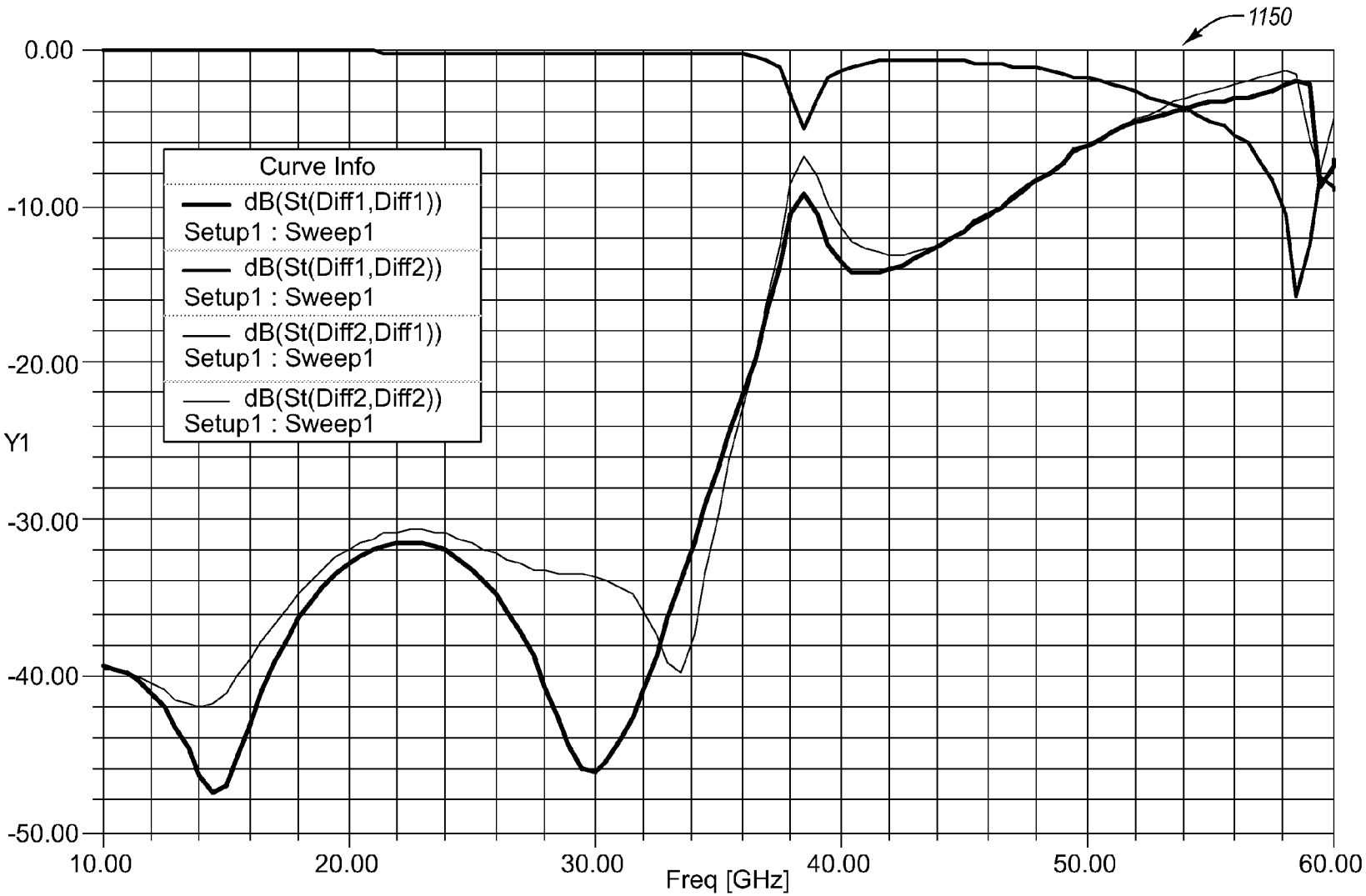
FIG. 11B is a chart showing simulated S-parameters of the example feed thru of FIG. 10B.

With reference now to FIGS. 11A and 11B, charts 1100 and 1150 showing simulated S-parameters of the example feed thrus 1000 and 1050 of FIGS. 10A and 10B, respectively, are disclosed. The charts 1100 and 1150 of FIGS. 11A and 11B demonstrate that the feed thru with a strong coupling 1000 of FIG. 10A can operate with a frequency range above about 55 GHz, while the feed thru with a weak coupling 1050 of FIG. 10B can only operate below about 40 GHz.

IV. Example Non-Coplanar Interconnects

With reference now to FIGS. 12-19, aspects of interconnects having non-coplanar geometries (non-coplanar interconnects) will be disclosed. The example non-coplanar interconnects disclosed herein can exhibit favorable RF performance in high-speed applications.

One environment in which the example non-coplanar interconnects disclosed herein can be employed is high-speed transponders. For example, transponders compliant with the 40 G 300 pin MSA may employ one or more of the example non-coplanar interconnects disclosed herein. Further, the example transponders 100 and 200 disclosed herein in connection with FIGS. 1 and 2, respectively, may employ one or more of the example non-coplanar interconnects disclosed herein. It is noted, however, that the example non-coplanar interconnects disclosed herein are not limited to employment in high-speed transponders, but can also be employed in any environment where an interconnect between two sets of high-speed transmission lines is necessary. The distance between the layers of traces or transmission lines disclosed herein is generally on the sub-millimeter scale, although other scales may also benefit from the example interconnects disclosed herein.

The term "non-coplanar" as used herein refers to an arrangement of transmission lines in an interconnect where the transmission lines are not substantially arranged in a single plane. For example, a non-coplanar interconnect could include ground transmission lines that are arranged in a first plane and signal transmission lines arranged in a second plane, where the first and second planes are substantially parallel or are not substantially parallel. Likewise, a non-coplanar interconnect could include transmission lines that are arranged in any geometry other than being substantially arranged in a single plane, such as a staggered geometry where the ground transmission lines and the signal transmission lines are not arranged in a pair of planes.

Figure 12:
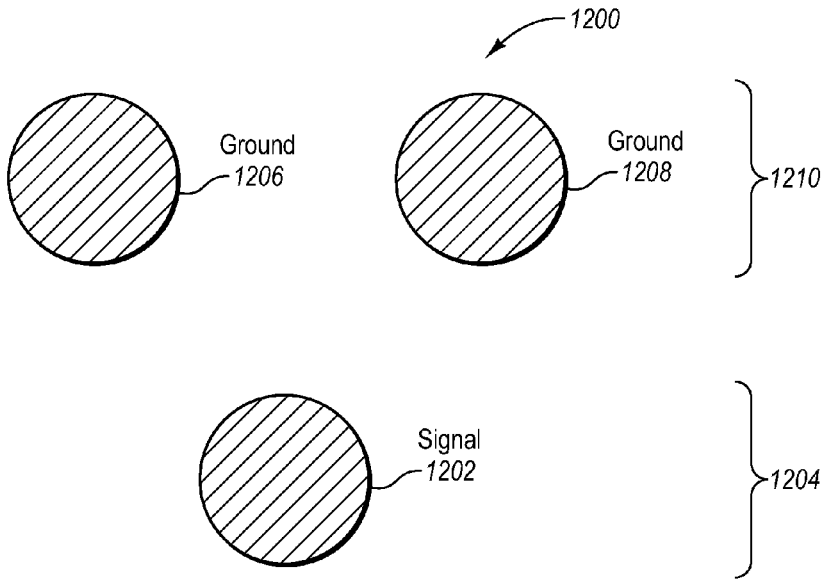
FIG. 12 is a top view of an example non-coplanar S/GG interconnect.

With reference now to FIG. 12, an example S/GG interconnect 1200 is disclosed. As disclosed in FIG. 12, the example S/GG interconnect 1200 includes one signal transmission line 1202 arranged in a first plane 1204 and two ground transmission lines 1206 and 1208 arranged in a second plane 1210. Unlike a conventional coplanar GSG interconnect, the example S/GG interconnect 1200 has a non-coplanar geometry. The example S/GG interconnect 1200 can be employed in a high-speed application to connect a first set of GSG single-ended transmission lines (not shown) to a second set of GSG single-ended transmission lines (not shown). The first set and second set of GSG single-ended transmission lines can be arranged, for example, on first and second layers of a multi-layer package (not shown). Example multi-layer packages include, but are not limited to, a multi-layer Low Temperature Co-fired Ceramic (LTCC) Ferro A-6 package or a multi-layer PCB.

Figure 13:
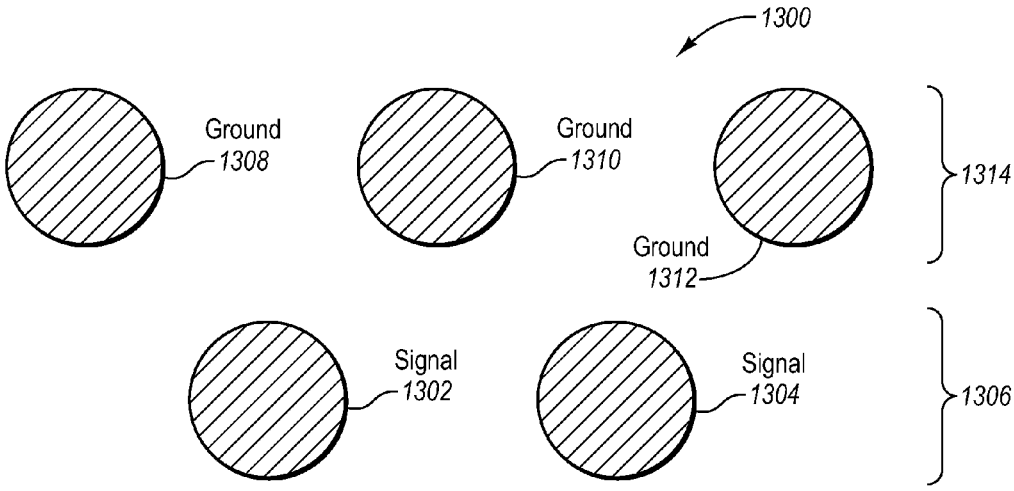
FIG. 13 is a top view of an example non-coplanar SS/GGG interconnect.

With reference now to FIG. 13, an example SS/GGG interconnect 1300 is disclosed. As disclosed in FIG. 13, the example SS/GGG interconnect 1300 includes two signal transmission lines 1302 and 1304 arranged in a first plane 1306 and three ground transmission lines 1308, 1310, and 1312 arranged in a second plane 1314. Unlike a conventional coplanar GSGSG interconnect, the example SS/GGG interconnect 1300 has a non-coplanar geometry. The example SS/GGG interconnect 1300 can be employed in a high-speed application to connect a first set of GSGSG differential pair transmission lines (not shown) to a second set of GSGSG differential pair transmission lines (not shown), for example, on first and second layers of a multi-layer package (not shown).

Figure 14:
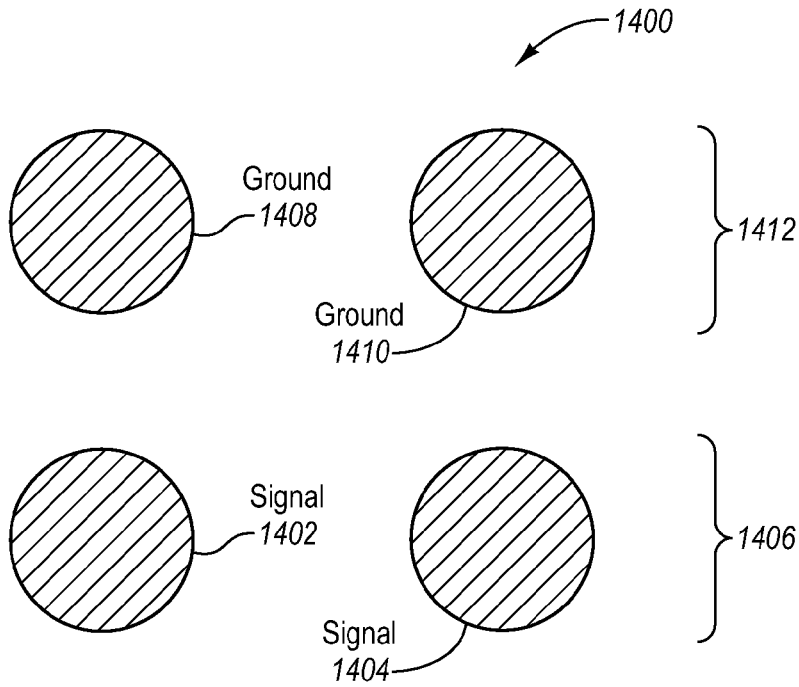
FIG. 14 is a top view of an example non-coplanar SS/GG interconnect.
Figure 15:
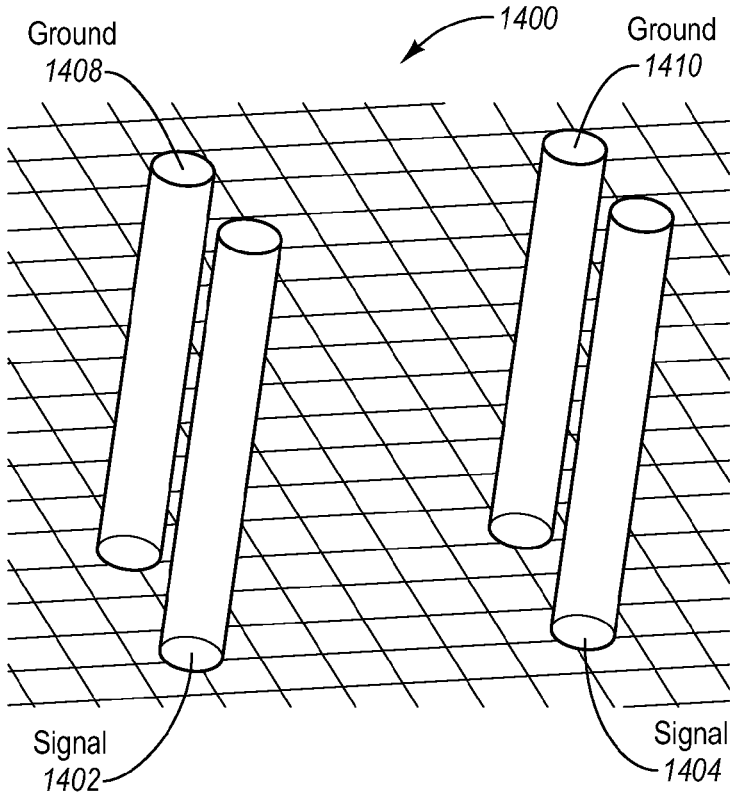
FIG. 15 is a perspective view the example non-coplanar SS/GG interconnect of FIG. 14.

With reference now to FIG. 14, an example SS/GG interconnect 1400 is disclosed. As disclosed in FIG. 14, the example SS/GG interconnect 1400 includes two signal transmission lines 1402 and 1404 arranged in a first plane 1406 and two ground transmission lines 1408 and 1410 arranged in a second plane 1412. Unlike a conventional coplanar GSSG interconnect, the example SS/GG interconnect 1400 has a non-coplanar geometry. The example SS/GG interconnect 1400 can be employed in a high-speed application to connect a first set of GSSG differential pair transmission lines to a second set of GSSG differential pair transmission lines, for example, on first and second layers of a multi-layer package, as discussed below in connection with FIGS. 16A and 16B. FIG. 15 is a perspective view of the example SS/GG interconnect 1400 of FIG. 14.

Figure 16A:
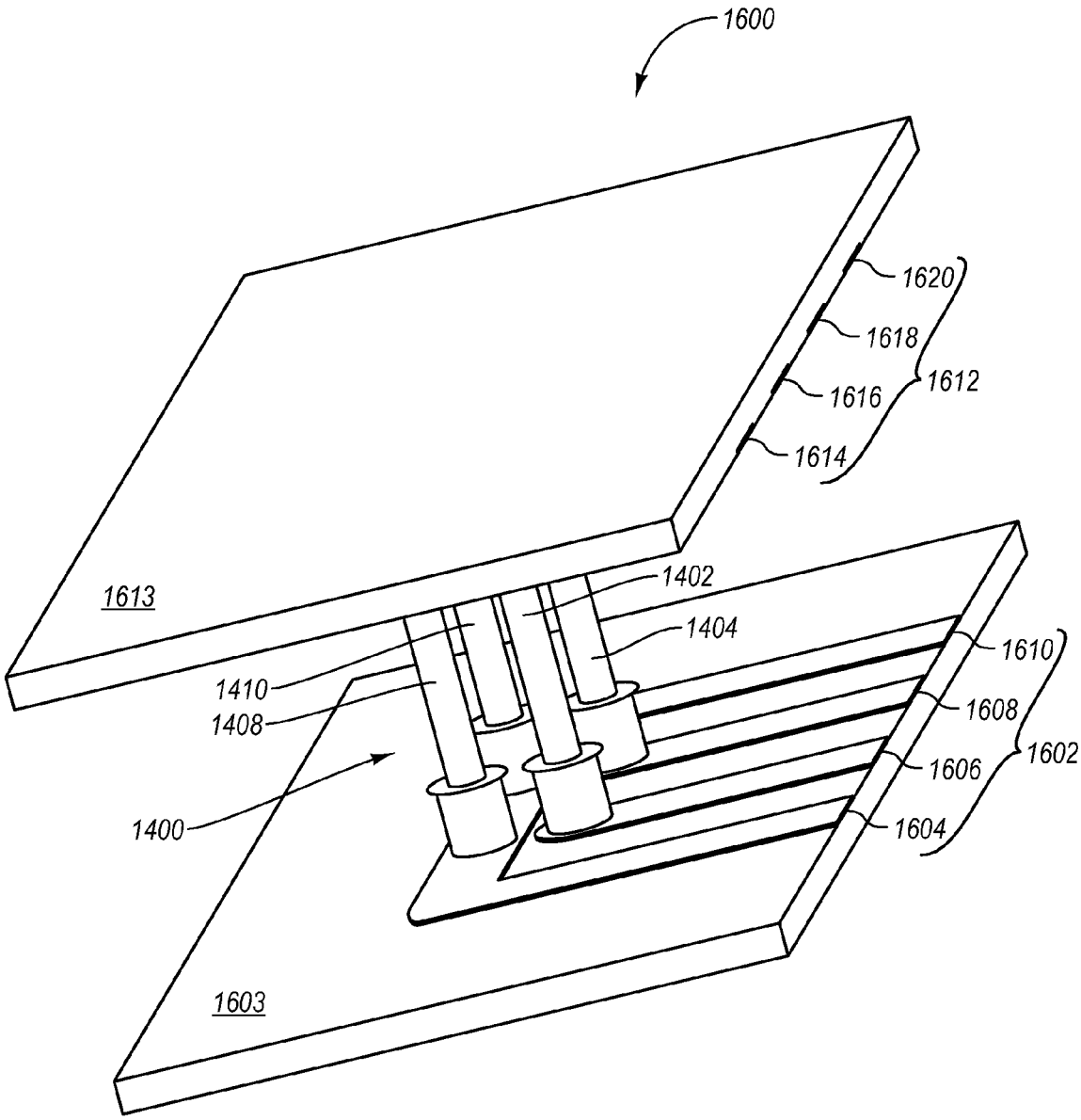
FIGS. 16A and 16B are perspective views of the example non-coplanar SS/GG interconnect of FIG. 14 employed in an example multi-layer package.
Figure 16B:
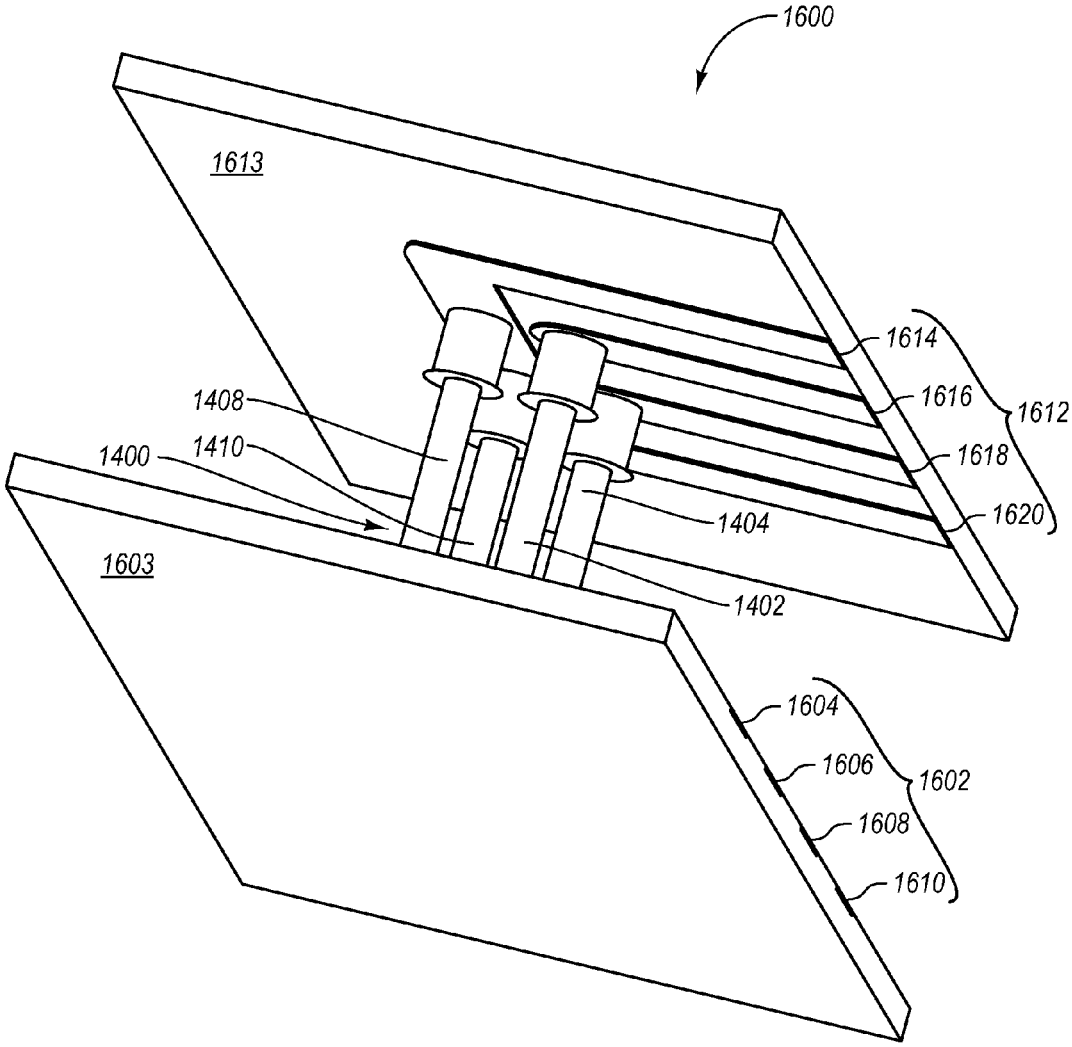

FIGS. 16A and 16B are perspective views of the example SS/GG interconnect 1400 of FIGS. 14 and 15 employed in an example multi-layer package 1600. As disclosed in FIG. 16A, the example SS/GG interconnect 1400 is connected to a first set 1602 of GSSG differential pair transmission lines on a first layer 1603. The first set 1602 of GSSG differential pair transmission lines includes a first ground line 1604, a first signal line 1606, a second signal line 1608, and a second ground line 1610. The two signal transmission lines 1402 and 1404 of the example SS/GG interconnect 1400 are connected to the first and second signal lines 1606 and 1608, respectively. The two ground transmission lines 1408 and 1410 of the example SS/GG interconnect 1400 are connected to the first and second ground lines 1604 and 1610, respectively. As disclosed in FIG. 16A, the first and second ground lines 1604 and 1610 may also be connected together.

As disclosed in FIG. 16B, the example SS/GG interconnect 1400 connects the first set 1602 of GSSG differential pair transmission lines to a second set 1612 of GSSG differential pair transmission lines on a second layer 1613. The second set 1612 of GSSG differential pair transmission lines includes a first ground line 1614, a first signal line 1616, a second signal line 1618, and a second ground line 1620. The two signal transmission lines 1402 and 1404 of the example SS/GG interconnect 1400 connect the signal line 1606 to the signal line 1616 and the signal line 1608 to the signal line 1618, respectively. The two ground transmission lines 1408 and 1410 of the example SS/GG interconnect 1400 connect the ground line 1604 to the ground line 1614 and the ground line 1610 to the ground line 1620, respectively.

Although the multi-layer package 1600 is disclosed in FIGS. 16A and 16B as having only two layers 1603 and 1613, it is contemplated that the example non-coplanar interconnects disclosed herein may also be implemented in multi-layer packages having three or more layers. Accordingly, the example non-coplanar interconnects disclosed herein may connect sets of transmission lines that are separated by one or more layers.

The example SS/GG interconnect 1400 enables high-speed signals to be transmitted between the first set 1602 of GSSG differential pair transmission lines arranged on the first layer 1603 and the second set 1612 of GSSG differential pair transmission lines arranged on the second layer 1613. As discussed below in connection with FIGS. 17 and 18, the example SS/GG interconnect 1400 enables high-speed signals to be transmitted between the first layer 1603 and the second layer 1613 with favorable RF performance at high-speeds.

Figure 17:
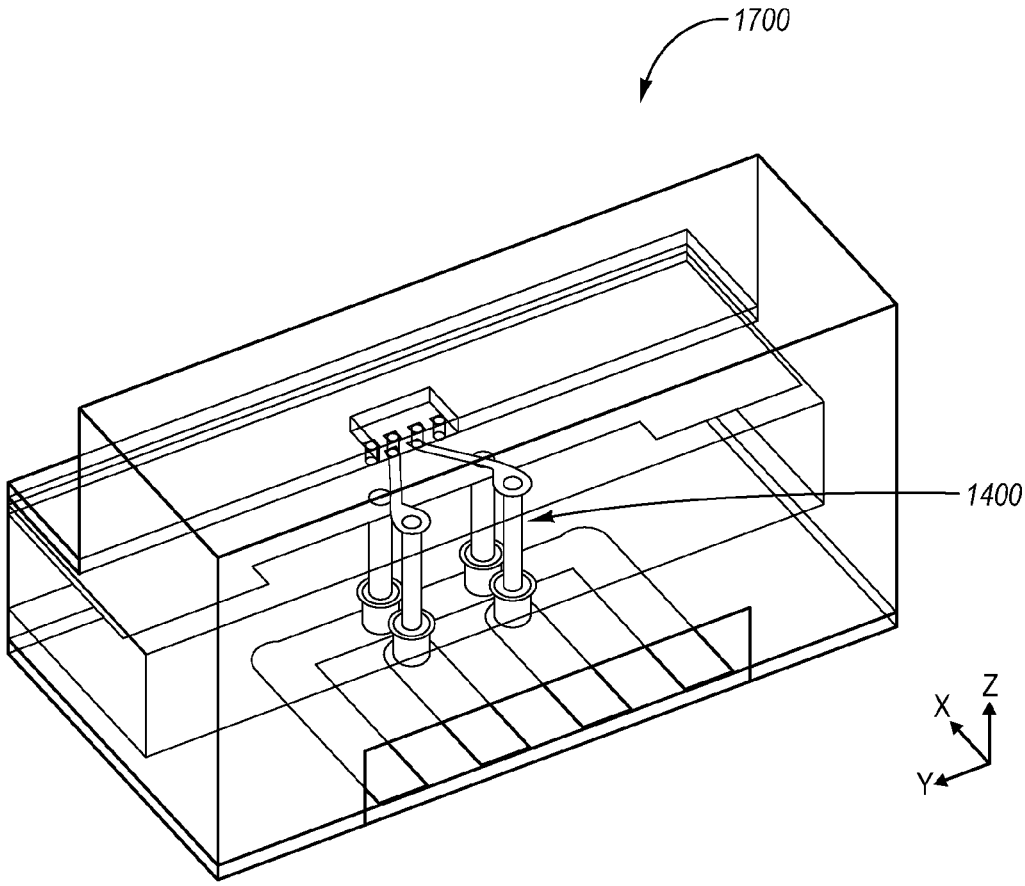
FIG. 17 is a perspective view of the example non-coplanar SS/GG interconnect of FIG. 14 employed in an example high-speed wideband performance simulation.

FIG. 17 is a perspective view of the example SS/GG interconnect 1400 of FIG. 14 employed in an example high-speed wideband performance simulation 1700. The charts disclosed in FIGS. 18 and 19 were generated using the example high-speed wideband performance simulation 1700.

Figure 18:
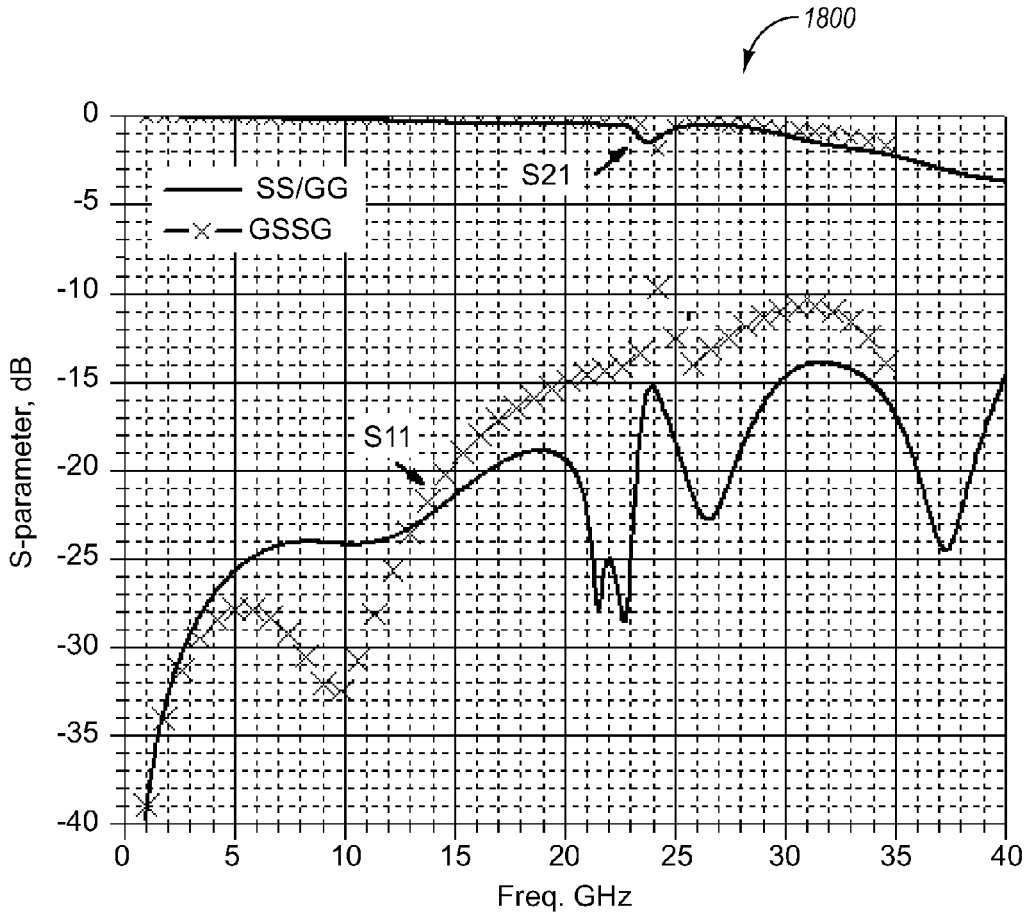
FIG. 18 is a chart comparing the forward transmission and reflection characteristics of a conventional coplanar GSSG interconnect and the example non-coplanar SS/GG interconnect of FIG. 14.

FIG. 18 is a chart 1800 comparing the forward transmission (S21) and reflection (S11) characteristics of a conventional coplanar GSSG interconnect and the example SS/GG interconnect 1400 of FIG. 14. As disclosed in FIG. 18, the example SS/GG interconnect 1400 exhibits an average 5 dB reduction in reflection (S11) from about 15 GHz to about 35 GHz in comparison with the conventional coplanar GSSG interconnect.

Figure 19:
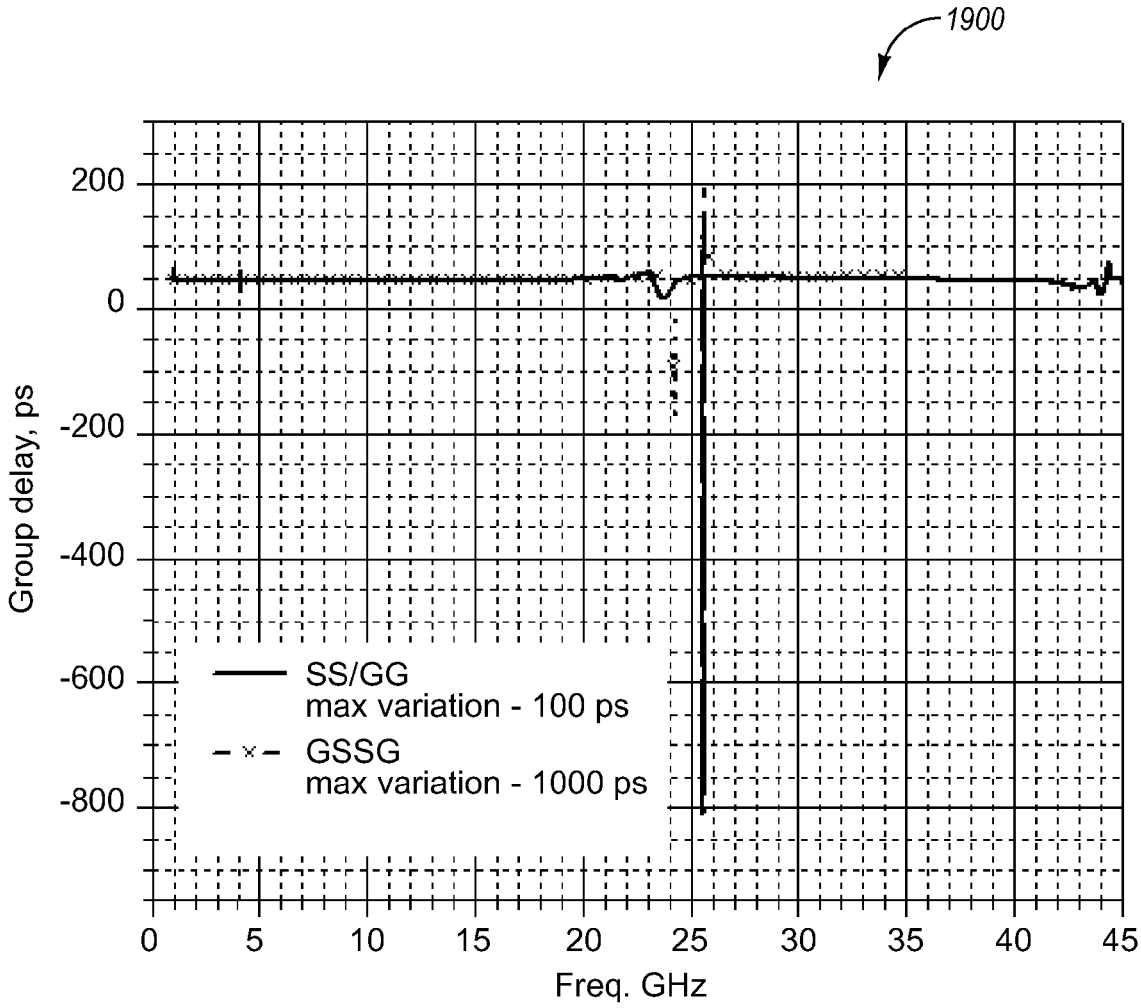
FIG. 19 is a chart comparing the group delay characteristics of a conventional coplanar GSSG interconnect and the example non-coplanar SS/GG interconnect of FIG. 14.

FIG. 19 is a chart 1900 comparing the group delay characteristics of a conventional coplanar GSSG interconnect and the example SS/GG interconnect of FIG. 14. As disclosed in FIG. 19, the example SS/GG interconnect 1400 exhibits improved group delay characteristics in comparison with the conventional coplanar GSSG interconnect.

The example embodiments disclosed herein may be embodied in other specific forms. The example embodiments disclosed herein are to be considered in all respects only as illustrative and not restrictive.

What is claimed is:

1. A high-speed transponder comprising:

a printed circuit board comprising a set of coplanar high-speed traces;

a first package mounted to the printed circuit board, the first package comprising a first set of coplanar high-speed transmission lines;

a non-coplanar high-speed interconnect connecting the set of coplanar high-speed traces to the first set of coplanar high-speed transmission lines;

a second package mounted to the printed circuit board, the second package comprising a second set of coplanar high-speed transmission lines; and a high-speed interconnect connecting the set of coplanar high-speed traces to the second set of coplanar high-speed transmission lines.

2. The high-speed transponder as recited in claim 1, wherein the non-coplanar high-speed interconnect comprises one of an S/GG interconnect, an SS/GGG interconnect, or an SS/GG interconnect.

3. The high-speed transponder as recited in claim 1, wherein the high-speed transponder is capable of transmitting high-speed signals between the first and second packages via the set of coplanar high-speed traces at speeds of about 40 G.

4. The high-speed transponder as recited in claim 1, wherein the non-coplanar high-speed interconnect comprises:

a first plane of transmission lines connecting one or more signal transmission lines from the set of coplanar high-speed traces to one or more corresponding signal transmission lines from the first set of high-speed transmission lines; and a second plane of transmission lines connecting one or more ground transmission lines from the set of coplanar high-speed traces to one or more corresponding ground transmission lines from the first set of high-speed transmission lines, wherein the first plane and the second plane are substantially parallel to each other.

5. The high-speed transponder as recited in claim 1, wherein:

the first package comprises an integrated circuit package;

the second package comprises an optoelectric circuit package; and the high-speed interconnect comprises a high-speed feed thru with a flipped signal plane.

6. A high-speed transponder comprising:

a printed circuit board comprising a set of high-speed traces;

a first high-speed package mounted to the printed circuit board, the first high-speed package comprising a first set of high-speed transmission lines;

a first high-speed interconnect comprising a non-coplanar high-speed interconnect connecting the set of high-speed traces to the first set of high-speed transmission lines;

a second high-speed package mounted to the printed circuit board, the second high speed package comprising a second set of high speed transmission lines; and a second high-speed interconnect connecting the set of high-speed traces to the second set of high-speed transmission lines.

7. The high-speed transponder as recited in claim 6, wherein the transponder is capable of transmitting high-speed signals between the first and second packages via the set of high-speed traces at speeds of about 40 G.

8. The high-speed transponder as recited in claim 6, wherein:

the first high-speed package comprises an integrated circuit package; and the second high-speed package comprises an optoelectric circuit package.

9. The high-speed transponder as recited in claim 8, wherein the second high-speed interconnect comprises a high-speed feed thru with a flipped signal plane.

* * * * *